US007987802B2

(12) United States Patent
Niedermair

(10) Patent No.: US 7,987,802 B2
(45) Date of Patent: Aug. 2, 2011

(54) ANCHOR LINE STABILIZER AND UNIVERSAL BRACKET

(76) Inventor: Donald S. Niedermair, Columbus, WI (US)

( * ) Notice: Subject to any disclaimer, the term of this patent is extended or adjusted under 35 U.S.C. 154(b) by 12 days.

(21) Appl. No.: 12/428,235

(22) Filed: Apr. 22, 2009

(65) Prior Publication Data

US 2009/0266287 A1 Oct. 29, 2009

Related U.S. Application Data

(60) Provisional application No. 61/047,475, filed on Apr. 24, 2008.

(51) Int. Cl.
*B63B 21/04* (2006.01)

(52) U.S. Cl. ..... 114/218; 24/115 R; 114/294

(58) Field of Classification Search ..... 114/218, 114/219, 294; 24/115 R, 130; D12/317
See application file for complete search history.

(56) References Cited

U.S. PATENT DOCUMENTS

| | | | | |
|---|---|---|---|---|
| 2,271,288 | A * | 1/1942 | Cuff | 24/130 |
| 3,869,114 | A | 3/1975 | Schneider | |
| 3,897,163 | A * | 7/1975 | Holmes | 24/130 |
| 4,011,974 | A * | 3/1977 | Scarola | 24/115 R |
| 4,065,822 | A | 1/1978 | Wilbourn | |
| 4,752,990 | A * | 6/1988 | Schutte | 24/115 R |
| 4,754,957 | A | 7/1988 | Muttart | |
| 5,207,171 | A | 5/1993 | Westwood, III | |
| 5,257,592 | A | 11/1993 | Schaefer | |
| 5,351,367 | A | 10/1994 | Kennedy et al. | |
| 5,449,151 | A | 9/1995 | Johnson | |
| 5,524,566 | A | 6/1996 | Rapa et al. | |
| 5,906,173 | A | 5/1999 | Day, Jr. et al. | |
| 5,950,284 | A | 9/1999 | Persson | |
| 5,987,707 | A | 11/1999 | DeShon | |
| 6,094,783 | A * | 8/2000 | Parsons | 24/130 |
| 6,152,060 | A * | 11/2000 | Steiner | 114/219 |
| 6,158,374 | A | 12/2000 | Free, Jr. | |
| 6,273,016 | B1 | 8/2001 | Gibbs | |
| 6,389,655 | B2 | 5/2002 | Libecco | |
| 6,390,009 | B2 | 5/2002 | Brown et al. | |
| 6,401,309 | B1 * | 6/2002 | Yang | 24/130 |
| 6,431,104 | B1 | 8/2002 | Webb | |
| D481,002 | S * | 10/2003 | Sherman et al. | D12/317 |
| 6,675,447 | B1 | 1/2004 | Hofeldt | |
| 6,824,330 | B2 | 11/2004 | Grobe | |
| 7,143,708 | B1 | 12/2006 | Cimino | |
| 7,353,766 | B1 * | 4/2008 | Wiese | 114/218 |
| 2006/0054070 | A1 | 3/2006 | Lopes Praca | |

FOREIGN PATENT DOCUMENTS

| | | |
|---|---|---|
| WO | WO 93/12968 | 7/1993 |

OTHER PUBLICATIONS www.drop-n-stay.com/dropnstay.asp, Innovative Marine Solutions, Aug. 2008.

* cited by examiner

*Primary Examiner* — Lars A Olson
(74) *Attorney, Agent, or Firm* — Lathrop & Clark LLP

(57) ABSTRACT

An anchor line stabilizer helps a boat remain a preferred distance away from an anchor which is located on a floor of a body of water. The anchor line stabilizer, among other things, allows the boat to move a short distance further than the preferred distance away from the anchor and then return to the preferred distance to allow for short brief movements caused by, for example, wind, waves and/or other intermittent forces.

19 Claims, 6 Drawing Sheets

ANCHOR LINE STABILIZER AND UNIVERSAL BRACKET

This application claims priority to U.S. Provisional Application 61/047,475, filed Apr. 24, 2008, which is incorporated herein by reference in its entirety.

FIELD

This invention relates to a stabilizing system for a boat anchor line.

BACKGROUND

Boat anchors are often used to hold a boat at or near a given location on a body of water. The weight and shape of the anchor promote a static position on the floor of the body of water, while an anchor line connecting the boat to the anchor holds the boat within a given distance of the anchor. By varying the length of the anchor line, a user can determine how near to each other the boat and the anchor will be maintained. The range of movement of a boat while attached to an anchor may be referred to as a swing scope and is related to the ratio between the length of the anchor line to the depth of the water. For example, as the length of the anchor line increases with respect to the depth of the water, the swing scope will increase. It may be desirable to allow for various amounts of swing scope in various situations.

SUMMARY

Ideally, a user would want to use an anchor line that is just long enough to allow the anchor to hit the bottom of the body of water (e.g., in a straight vertical line between the anchor and the boat). This would help keep the boat in a precise location above the anchor.

However, in choppy or rough waters, e.g., water with a large number and/or size of waves, wind and/or other forces, traditional boat anchors can be moved by the waves and/or other forces. If, for instance, a wave hits the boat and raises the level of the boat relative to the bottom of the body of water, the anchor may be lifted off the floor allowing the boat to move with the wave. After the wave has passed the boat, the anchor may then again hit the floor, but may be in a different location. If the anchor has moved, the anchor has been ineffective at keeping the boat in a desired location. If the anchor is pulled off of the floor, it is likely to have been moved.

Even when the anchor is not lifted off the floor, the anchor, and thus the boat, may move if the wave is strong enough to drag the anchor across the floor. It should be appreciated that other forces, such as wind, may also cause in whole or in part, movement of the boat.

In some instances, the user may use an anchor line that is longer than the length necessary to allow the anchor to reach the floor of the body of water. This allows the boat to move within a hemisphere that has an outer surface that is a distance away from the anchor equal to the length of the anchor line. This hemisphere, its radius and/or its diameter may also be referred to as the swing scope of the boat. This will allow the boat to move vertically as well as across the surface of the body of water within the hemisphere without the anchor moving. While this solution allows the boat to stay within a defined area near the desired location, there is no mechanism to keep the boat at a preferred location, nor a mechanism to return the boat to the preferred location if it moves. Likewise, the boat may still be moved further than the limit of the swing scope if forces are strong and/or consistent enough.

Additionally, as a boat moves to the limit of the swing scope, the anchor line will be drawn taught and any further forces or stresses may be translated to the boat and/or the point (e.g., hook) where the anchor line is attached to the boat. This stress can cause damage to the boat and/or the anchor line (e.g., the mounting hook can be broken or the anchor line can be snapped).

As such, it would be preferable to allow a boat freedom to move short distances away from a preferred location and/or a preferred area while at the same time encouraging the boat to return to the preferred location and/or preferred area.

This invention provides an anchor line stabilizer that will allow a boat freedom to move short distances away from a preferred location.

This invention separately provides an anchor line stabilizer that will draw a boat back toward a preferred location after having been moved away from the preferred location.

This invention separately provides an anchor line stabilizer that can be installed on a deployed anchor line without the need for a free end of the anchor line.

This invention separately provides an anchor line stabilizer connected to an anchor and a boat that is installed between ends of an anchor line without having to disconnect either end.

This invention separately provides an anchor line stabilizer that allows the anchor line to stay coupled to a boat and anchor so that the anchor and boat remain operatively coupled in the event the anchor line stabilizer becomes uncoupled or otherwise fails.

This invention separately provides an anchor line stabilizer that absorbs some of the energy of waves to reduce "boat slap".

This invention separately provides a flexible member (e.g., a bungee cord) that can be coupled to an anchor line to effectively allow the line to stretch or flex.

This invention separately provides a universal bracket for coupling an anchor line stabilizer to an anchor line of a boat.

This invention separately provides a universal bracket for coupling multiple ropes, lines or the like.

In various exemplary embodiments, an anchor line stabilizer is installed parallel to an anchor line of the boat. That is to say that, at least a portion of the anchor line and the anchor line stabilizer are each connected at the same location. In various ones of these exemplary embodiments, the anchor line stabilizer is connected to two points on the anchor line creating a loop or subsection of the anchor line that is parallel to the anchor line stabilizer i.e., the subsection of the anchor line is connected to the rest of the anchor line at the same point(s) as the anchor line stabilizer. It should be appreciated that, by saying the subsection of the anchor line is connected to the rest of the anchor line at one or more points, it is not implied that the anchor line is cut or otherwise discontinuous at any point(s).

In various exemplary embodiments, an anchor line stabilizer is attached to an anchor line of a boat such that it will resist allowing the boat to move away from a preferred location. In various exemplary embodiments, the anchor line stabilizer will stretch or become otherwise deformed as a force moves the boat away from the preferred location. In various ones of these exemplary embodiments, the anchor line stabilizer will retract, relax or shrink after the force has subsided and/or weakened. In various ones of these exemplary embodiments, as the anchor line stabilizer retracts, relaxes or shrinks, the boat will be drawn back towards the preferred location.

In various exemplary embodiments, an anchor line stabilizer can be coupled to an anchor line of a boat without needing a free end of the anchor line. In various ones of these exemplary embodiments, the anchor line stabilizer has one or more brackets that may be coupled to the anchor line without the need for a free end of the anchor line. In such exemplary embodiments, the bracket(s) can be attached to the anchor line after the anchor line is coupled to both an anchor and the boat. In various ones of these exemplary embodiments, the bracket(s) are configured to accept a loop of the anchor line, which is then secured to the bracket(s). The bracket(s) are then coupled to the rest of the anchor line stabilizer.

In various exemplary embodiments, an anchor line stabilizer is constructed, in part, of a bungee cord or other expandable cord, rope, line and/or the like. In such exemplary embodiments, the bungee cord or other expandable cord, rope, line and/or the like can be stretched to allow the anchor line stabilizer to increase in length. In various ones of these exemplary embodiments, the bungee cord or other expandable cord, rope, line and/or the like is attached to one or more brackets, which are attached to an anchor line of a boat.

These and other features and advantages of various exemplary embodiments of systems and methods according to this invention are described in, or are apparent from, the following detailed descriptions of various exemplary embodiments of various devices, structures and/or methods according to this invention.

DRAWINGS

Various exemplary embodiments of the systems and methods according to this invention will be described in detail, with reference to the following figures, wherein.

DETAILED DESCRIPTION

Figure 1:
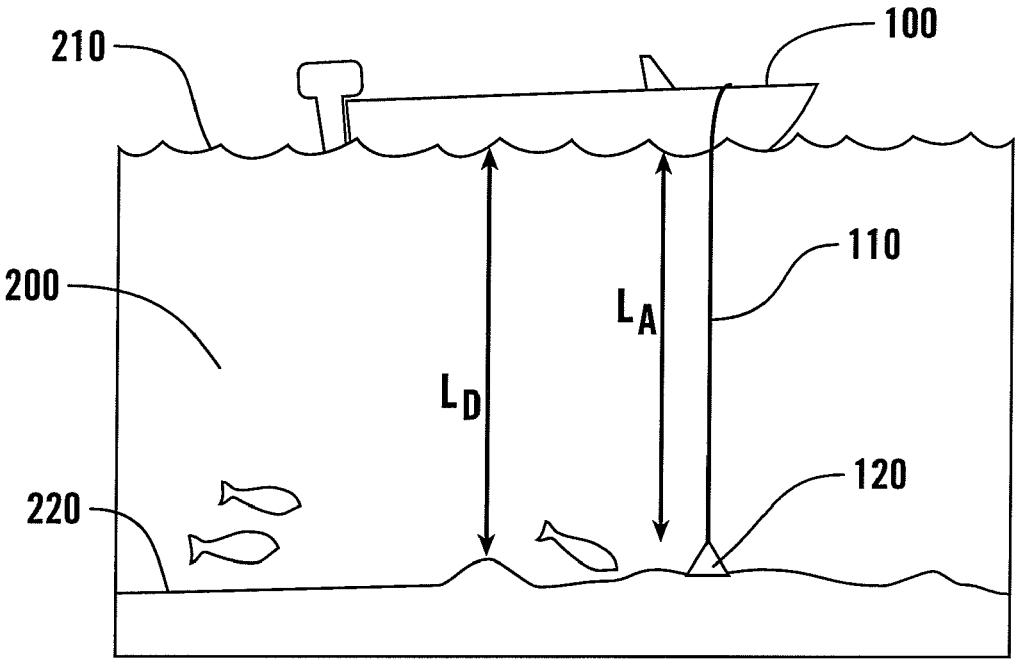
FIG. 1 is a side plan view of a boat and a conventional anchor line attached to an anchor.

FIG. 1 shows a boat 100 floating on a body of water 200. Body of water 200 has a surface 210 and a floor 220. A distance $L_D$ between surface 210 and floor 220 of body of water 200 is variable and may change as wave and tide conditions change. As shown in FIG. 1, boat 100 is coupled to an anchor line 110 which is also coupled to an anchor 120 positioned at a location on floor 220 of body of water 200. Anchor line 110 includes a length $L_A$, which is a distance of the length of anchor line 110 to surface 210 of body of water 200. Anchor 120 is weighted, shaped, or otherwise adapted to resist movement from its location on floor 220 of body of water 200. In this scenario, boat 100 is able to move around on surface 210 of body of water 200 within an approximate distance $L_A$ from the location of anchor 120 without anchor 120 moving from the location.

It should be appreciated that, a floating boat 100 is typically substantially on surface 210 of body of water 200. As such, boat 100 is able to move within a circle on surface 210 of body of water 200 that has an outer edge, which is a distance of approximately $L_A$ from anchor 120. However, as stated above, depth $L_D$ of body of water 200 may not be constant or fixed. As distance $L_D$ between surface 210 and floor 220 of body of water 200 increases, the circle within which boat 100 may move contracts until, when distance $L_D$ is approximately equal to length $L_A$, boat 100 is substantially restricted to approximately a single spot substantially directly above anchor 120, unless anchor 120 moves.

It should be appreciated that the area, radius and diameter of the circle on surface 210 of body of water 200 within which boat 100 is restricted can be calculated (e.g. using trigonometry) or at least approximated if length $L_A$ and depth $L_D$ are known. For example, a right triangle may be made between length $L_A$, depth $L_D$ and the radius of the circle within which the boat 100 is restricted, with length $L_A$ being the hypotenuse.

If boat 100 is forced to move further than distance $L_A$ from the location of anchor 120 by wind, waves and/or other forces, anchor 120 will typically either lift off of floor 220 of body of water 200 or will be dragged across floor 220 of body of water 200. Typically, to help prevent or limit movement of boat 100 further than $L_A$ from the location of anchor 120, a user may use multiple anchors. For example, the use of multiple anchors may help increase the anchor mass holding the boat in place and/or to divide the forces across multiple anchor lines. A user may also use an anchor line with a longer length $L_A$, which will help alleviate forces that may cause the anchor to lift from the floor.

Figure 2:
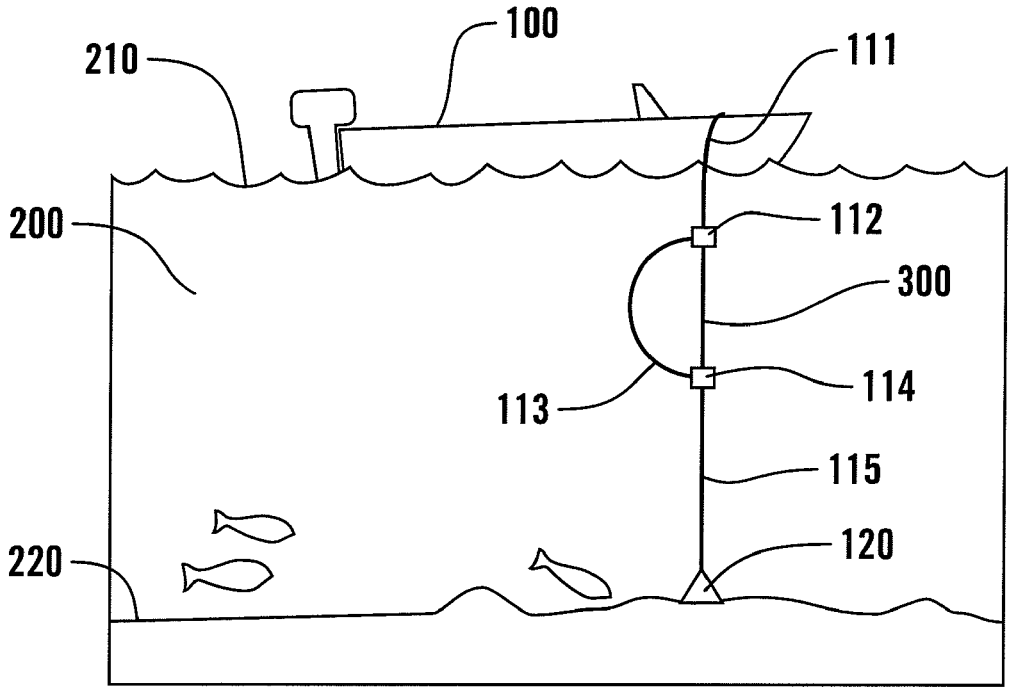
FIG. 2 is a side plan view of a boat using an anchor line stabilizer according to an exemplary embodiment.

As shown in FIG. 2, an exemplary embodiment of an anchor line stabilizer 300 may be coupled to anchor line 110 of boat 100. As shown in FIG. 2, in various embodiments, anchor line stabilizer 300 is coupled to anchor line 110 at points 112 and 114 to help create a loop 113 in anchor line 110. Meanwhile, a substantially straight line is generally maintained between boat 100 and anchor 120 by portions 111 and 115 of anchor line 110 and anchor line stabilizer 300.

As forces, such as waves and/or wind, urge boat 100 away from anchor 120, anchor line stabilizer 300 may be stretched from a relaxed length. In various embodiments, as anchor line stabilizer 300 stretches, it becomes harder to stretch anchor line stabilizer 300 further, until anchor line stabilizer 300 reaches the limit of its stretchable length or the stretched length of anchor line stabilizer 300 is equal to the length of loop 113, at which time any further forces that act upon boat 100 may be substantially translated to anchor line 110.

It should be appreciated that anchor line stabilizer 300 has the effect of giving anchor line 110 a variable length $L_A$. Variable length $L_A$ of anchor line 110 allows boat 100 to better track variable depth $L_D$ of body of water 200. Furthermore, anchor line stabilizer 300 helps absorb shock between boat 100 and anchor line 110. For example, when a wave or other force lifts or moves boat 100, boat 100 is lifted or moved relatively more smoothly than without anchor line stabilizer 300. The smoothed or subdued motion of boat 100 may also help boat 100 to better "ride" the waves and reduce "boat slap," the effect of boat 100 falling abruptly and/or violently against surface 220 of body of water 200 after having been lifted by a wave or other force, as well as reduce some of the conditions responsible for sea or motion sickness.

Additionally, the shock-absorbing effect of anchor line stabilizer 300 can be useful when a motorized anchor-lifting device is used. In some instances, motorized anchor lifting devices can experience violent jerking motions when the anchor line is pulled taught by a moving boat. This violent motion can cause undue stress on the motorized anchor-lifting device. The anchor line stabilizer may absorb some or all of this stress and/or jerking motion so that the anchor-lifting device does not experience some or all of the violent jerking motions. When the anchor line stabilizer is used in such a way, the anchor line stabilizer may be installed after the anchor is lowered and removed before the anchor is lifted by the anchor-lifting device. Likewise, the anchor line stabilizer may absorb some or all of the stress and/or jerking motion experiences by a connection point between the anchor line and the anchor and/or the boat.

It should be appreciated that points 112 and 114 may be anywhere on the anchor line 110. In various exemplary embodiments, points 112 and 114 are spaced apart a distance that is shorter than the limit of the stretchable length of anchor line stabilizer 300. In this way, the length of loop 113 is shorter than the maximum stretched length of anchor line stabilizer 300. As such, when the loop is straightened or pulled substantially taut, additional forces on the boat or the anchor line will be translated to the anchor line rather than the anchor line stabilizer. This may help in preventing the anchor line stabilizer from being stretched far beyond its recommended limit. In various exemplary embodiments, point 112 is preferably close to or above surface 220 of body of water 200. In this way, a user can easily access loop 113 of anchor line 110. As such, a user can safely retrieve anchor 120 by pulling on loop 113, and thus anchor line 110, without stretching anchor line stabilizer 300.

It should be appreciated that anchor line stabilizer 300 does not require a free end of anchor line 110 to be coupled to anchor line 110. As such, anchor line stabilizer 300 may be coupled to anchor line 110 before, during or after anchor 120 is coupled to anchor line 110 and/or before, during or after anchor 120 is placed in body of water 200 or otherwise deployed. Alternatively, anchor line stabilizer 300 may be installed between a free end of anchor line 110 and boat 100 and/or anchor 120.

After anchor line stabilizer 300 is coupled to anchor line 110, if anchor 120 has not already been placed in body of water 200, anchor 120 is placed in body of water 200. Anchor 120 should settle to floor 220 of body of water 200 and, in various embodiments, preferably slightly stretch anchor line stabilizer 300. When anchor line stabilizer 300 is slightly stretched, it helps maintain a substantially straight line between boat 100 and anchor 120 made by portions 111 and 115 of anchor line 110 and anchor line stabilizer 300.

Figure 3:
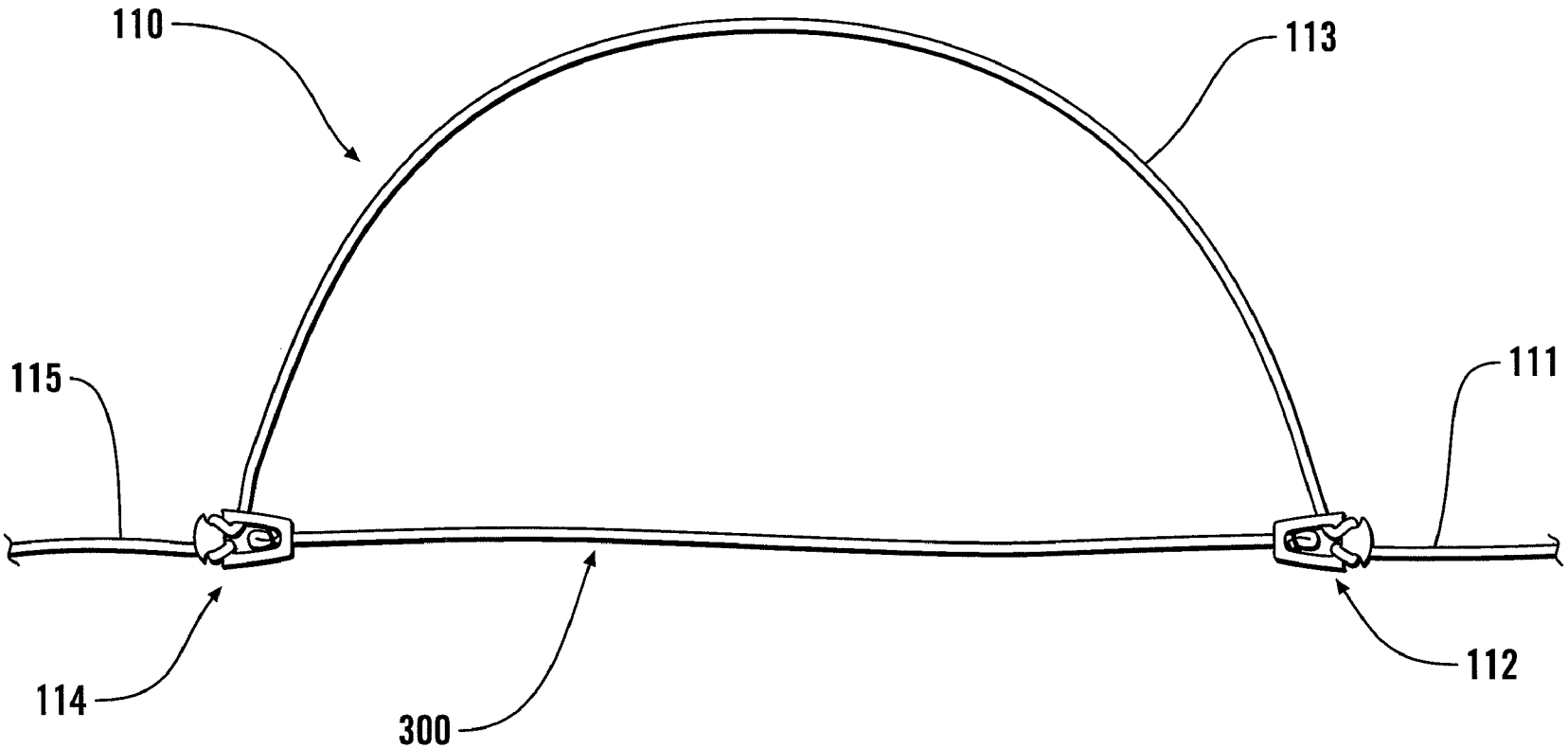
FIG. 3 is a front plant view of an anchor line stabilizer according to a first exemplary embodiment coupled to an anchor line.

FIG. 3 shows a more detailed view of a first exemplary embodiment of anchor line stabilizer 300 coupled to anchor line 110. As shown in FIG. 3, anchor line stabilizer 300 is coupled to anchor line 110 at two points 112 and 114, creating loop 113 in anchor line 110. It should be appreciated that there are numerous methods for coupling anchor line stabilizer 300 to anchor line 110. Various embodiments of anchor line stabilizer 300 may be coupled to anchor line 110 using various methods.

Figure 4:
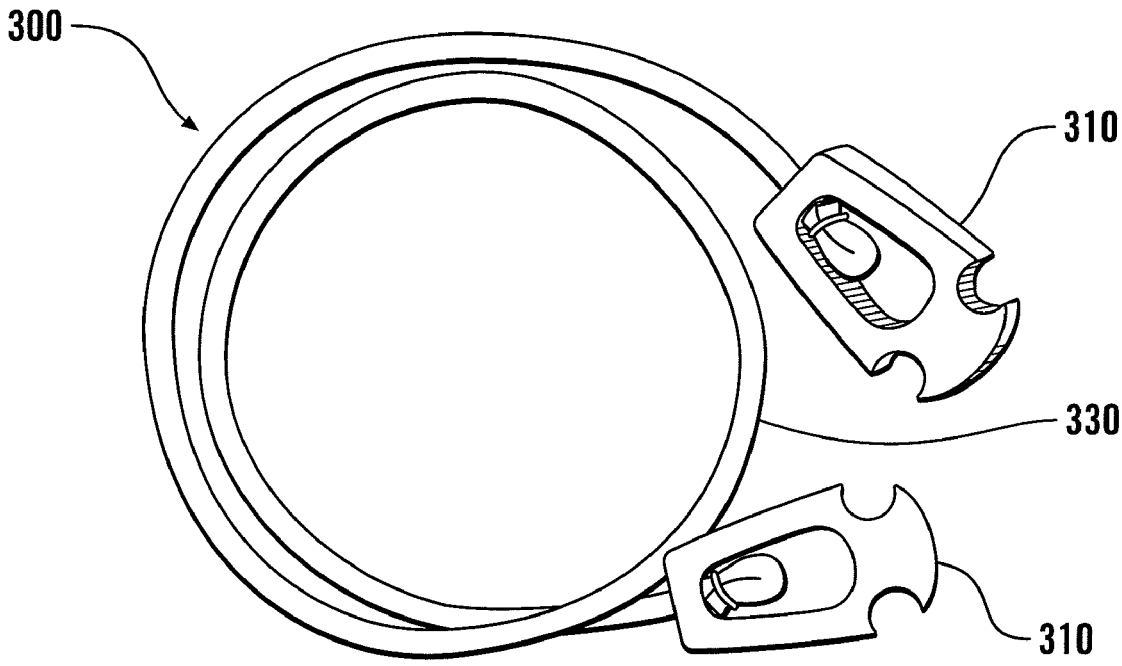
FIG. 4 is an isometric view of an anchor line stabilizer according to a first exemplary embodiment.

FIG. 4 shows a first exemplary embodiment of anchor line stabilizer 300. As shown in FIG. 4, the first exemplary embodiment of anchor line stabilizer 300 includes a flexible member 330 and a pair of first exemplary embodiments of a bracket 310, and each bracket 310 is attached to opposing ends of flexible member 330. Flexible member 330 may be joined to brackets 310 using any suitable known or later-developed method. For example, as shown in FIG. 4, the free ends of flexible member 330 are fed through apertures (e.g., holes) defined in the first exemplary embodiment of bracket 310. In various embodiments, the free ends of flexible member 330 are then folded over onto themselves and secured. By folding the free ends over and securing them to flexible member 330, the thickness of the end portions of flexible member 330 are overlapped which helps prevent the end portions from pulling back through the aperture defined in the bottom of the first exemplary embodiments of the bracket 310.

Figure 5:
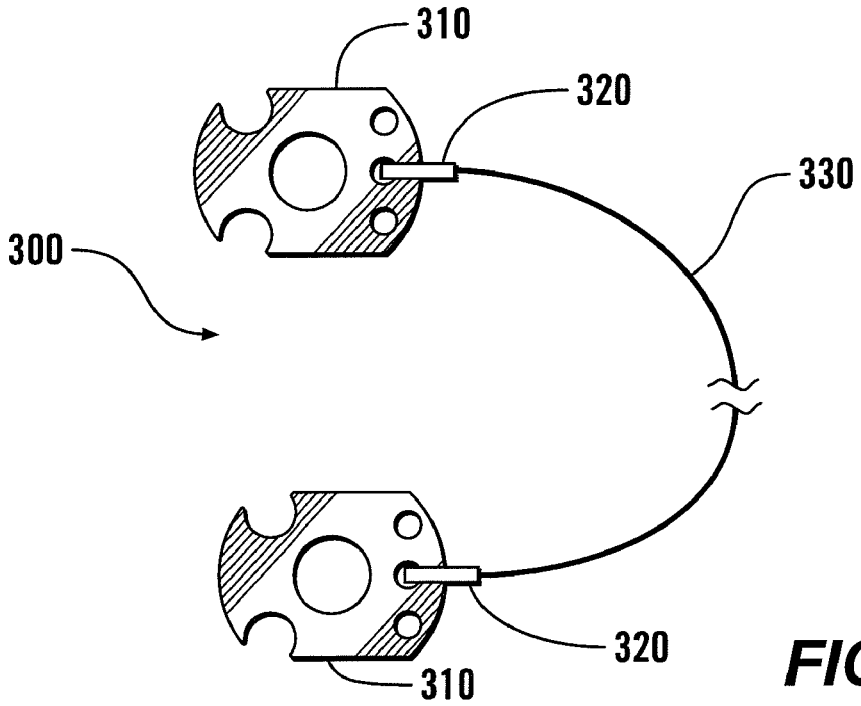
FIG. 5 is a front plan view of an anchor line stabilizer according to a second exemplary embodiment.

FIG. 5 shows a second exemplary embodiment of anchor line stabilizer 300. As shown in FIG. 5, in this second exemplary embodiment, anchor line stabilizer 300 has a pair of second exemplary embodiments of bracket 310, a pair of clips 320 and flexible member 330. In various embodiments, clips 320 are attached to opposing ends of flexible member 330. Each clip 320 may also be coupled to one of the pair of second exemplary embodiments of bracket 310.

Flexible member 330 may be constructed of any suitable known or later-developed material. For example, as shown in FIGS. 4 and 5, flexible member 330 is constructed primarily of bungee cord. However, flexible member 330 need not be a cord and may be constructed of any material having suitable elastic qualities, such as a spring or a spring-aided device. Bracket 310 may also be constructed of any suitable known or later-developed material. For example, as shown in FIG. 4, bracket 310 may be constructed of wood or a wood plastic composite. As shown in FIG. 5, bracket 310 may be constructed primarily of high-density plastic. While bracket 310 may also be made of metal material(s), wood and/or plastic material may be less likely to scratch or otherwise damage the boat and are unlikely to rust or oxidize. Clips 320 may also be constructed of any suitable materials. For example, any variety of clips typically attached to a bungee cord may be utilized. In various exemplary embodiments, however, clips made of plastic or other non-metallic material may be advantageous in that they are less likely to scratch or damage a boat or other objects and are less likely to rust or oxidize. The brackets and clips may also be constructed of nylon composite materials.

Figure 6:
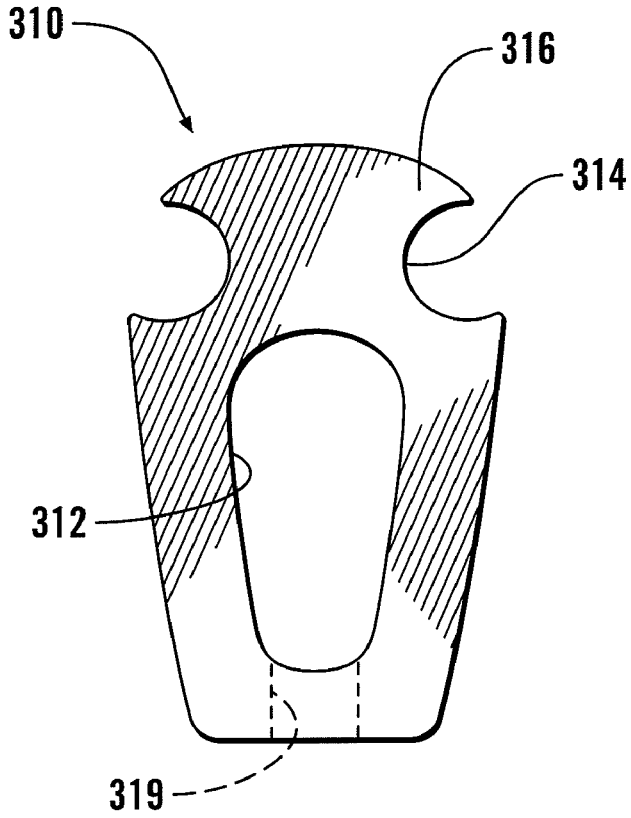
FIG. 6 is a front plan view of a bracket according to a first exemplary embodiment.
Figure 7:
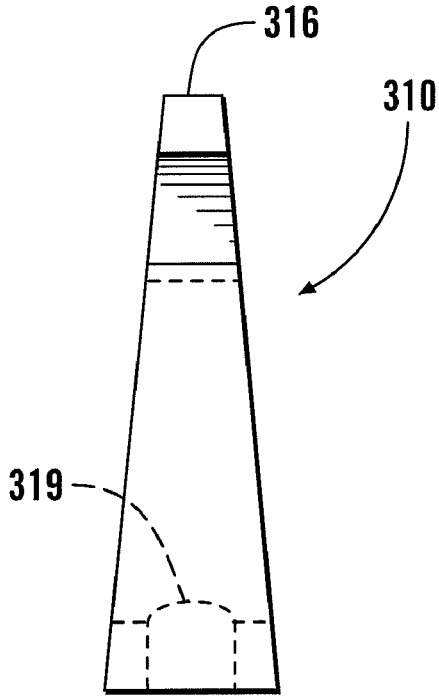
FIG. 7 is a side plan view of a bracket according to a first exemplary embodiment.
Figure 8:
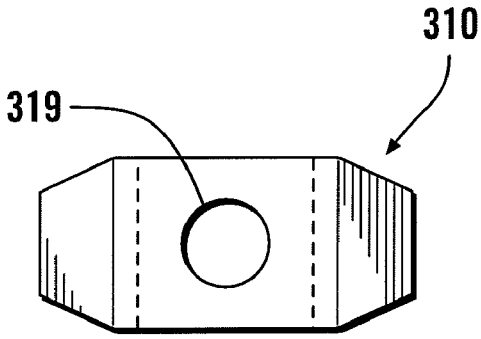
FIG. 8 is a bottom plan view of a bracket according to a first exemplary embodiment.

FIGS. 6-8 show the first exemplary embodiment of bracket 310 in greater detail. As shown in FIG. 6, bracket 310 defines a line passage hole 312 and two channels 314, which help form a hook 316. As shown in FIG. 7, the first exemplary embodiment of bracket 310 has a tapered profile. For example, as shown in FIG. 7, bracket 310 is thinner near hook 316, than at the opposite end. As shown in FIG. 8, bracket 310 defines a receiving hole 319 at the end of bracket 310 opposite from hook 316. In various embodiments, receiving hole 319 passes from the end of the bracket 310 into the inside edge where it intersects line passage hole 312. Receiving hole 319 is shown in phantom lines in FIGS. 7 and 8. Receiving hole 319 allows flexible member 330 to be inserted through and secured to bracket 310.

Figure 9:
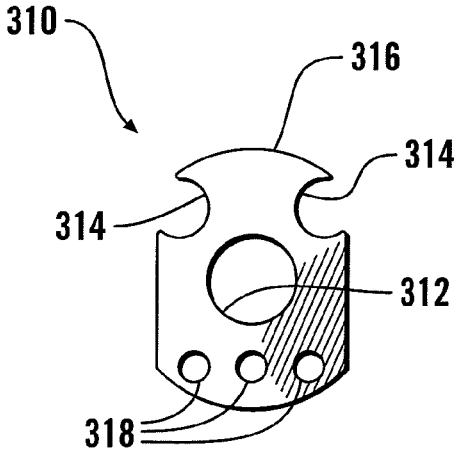
FIG. 9 is a front plan view of a bracket according to a second exemplary embodiment.

FIG. 9 shows the second exemplary embodiment of bracket 310 in greater detail. As shown in FIG. 9, second bracket 310 defines a line passage hole 312, two channels 314, which help form a hook 316, and three receiving holes 318. As shown in FIG. 9, line passage hole 312 is preferably centrally located. Channels 314 are located on the outer perimeter of bracket 310 such that a loop of a line can be placed in channels 314 and wrapped at least partially around hook 316. In the embodiment shown in FIG. 9, receiving holes 318 are located near the end of the bracket opposite from the hook 316.

It should be appreciated that bracket 310 may have more than one hook 316, created by more than two channels 314. It should also be appreciated that bracket 310 may have any number of receiving holes 318. Further, some or all of the apertures defined by bracket 310 may have beveled edges to, for example, reduce wear and tear.

Figure 10:
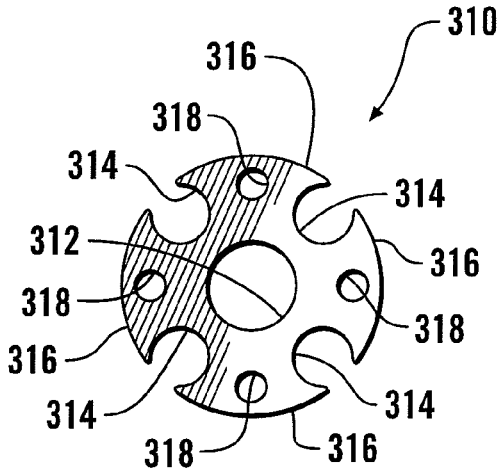
FIG. 10 is a front plan view of a bracket according to a third exemplary embodiment.

FIG. 10 shows a third exemplary embodiment of bracket 310. As shown in FIG. 10, bracket 310 has line passage hole 312, four channels 314 which create four hooks 316 and four receiving holes 318. As shown in FIG. 10, in various embodiments, line passage hole 312 is centrally located. In various embodiments, channels 314 are located near the outer perimeter of bracket 310. In various embodiments, each receiving hole 318 is located on the end of bracket 310 opposite from each hook 316. In the third exemplary embodiment of bracket 310, more than one line can be coupled or otherwise joined to bracket 310 at one time. Bracket 310 may thus be used to couple two or more lines together.

Figure 11:
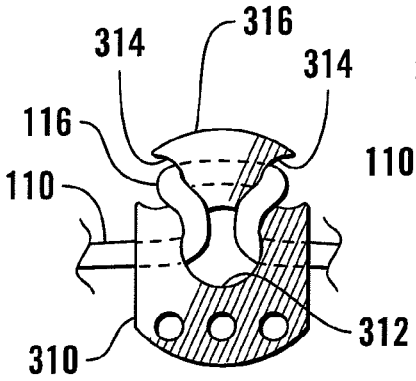
FIG. 11 is a front plan view of bracket according to a second exemplary embodiment coupled to an anchor line according to a first exemplary method.
Figure 12:
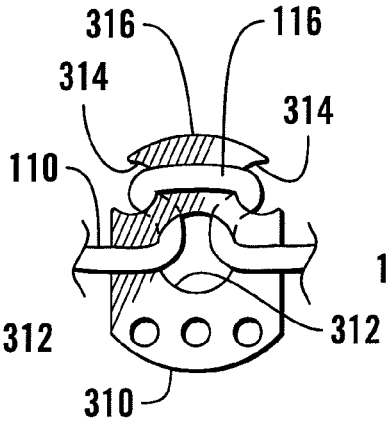
FIG. 12 is a rear plan view of a bracket according to a second exemplary embodiment coupled to an anchor line according to a first exemplary method.
Figure 13:
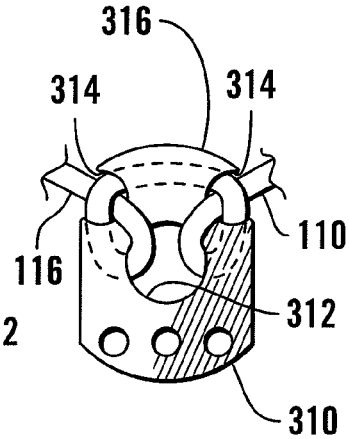
FIG. 13 is a front plan view of a bracket according to a second exemplary embodiment coupled to an anchor line according to a second exemplary method.

FIGS. 11-13 show various views of two exemplary methods for attaching anchor line 110 to bracket 310. FIGS. 11 and 12 show front and back views of a first such exemplary method, respectively. As shown in FIGS. 11 and 12, a loop 116 is provided in anchor line 110 and is inserted through line passage hole 312. In various embodiments, loop 116 is then inserted into a first channel 314, wrapped at least partially around hook 316 and then inserted into a second channel 314. Anchor line 110 is then tightened to bracket 310. FIG. 13 shows a front view of a second exemplary method of wrapping loop 116 around hook 316. As shown in FIG. 13, loop 116 may be wrapped around itself before wrapping loop 116 around hook 316.

It should be appreciated that, while FIGS. 11-13 show two exemplary embodiments of a method for coupling the loop 116 and/or the anchor line 110 to the bracket 310, there are numerous other ways that the loop 116 and/or anchor line 110 can be attached, connected, coupled, or otherwise joined to the bracket 310. Certain methods of coupling the loop 116 and/or anchor line 110 to the bracket 310 may be preferable in certain situations and should be appreciated to be other embodiments of the two methods illustrated in FIGS. 11-13. Furthermore, it should be appreciated that, although FIGS. 11-13 show the second exemplary embodiment of bracket 310, other embodiments of bracket 310, including the first and third exemplary embodiments outlined above, can be used in place of, or in conjunction with, second exemplary embodiment of bracket 310.

Figure 14:
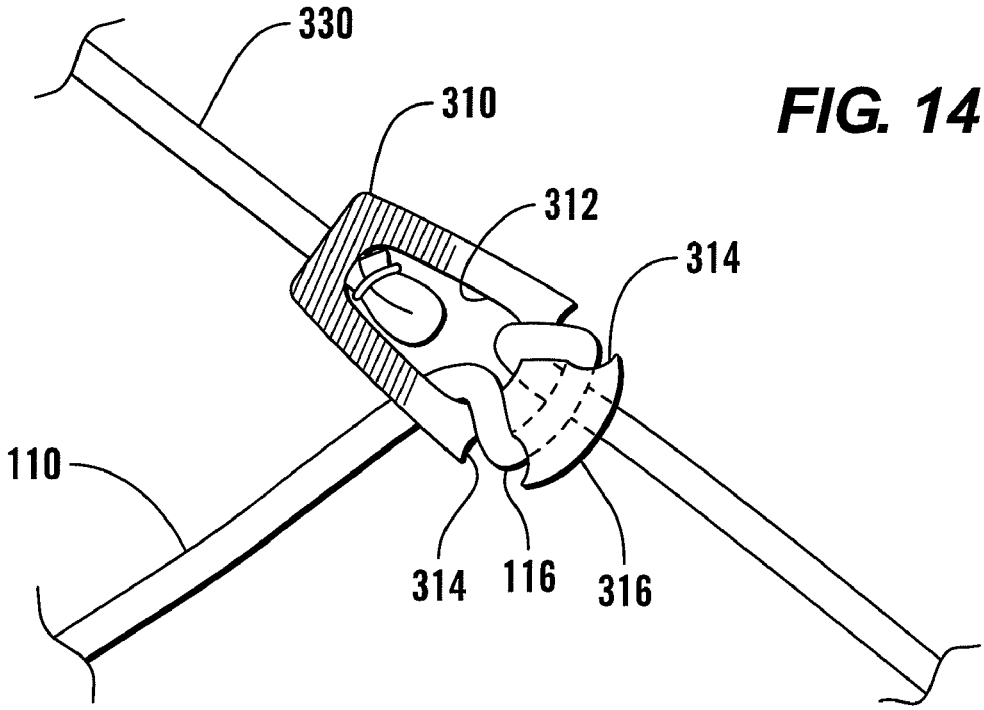
FIG. 14 is a front isometric view of a bracket according to a first exemplary embodiment coupled to an anchor line according to the first exemplary method.
Figure 15:
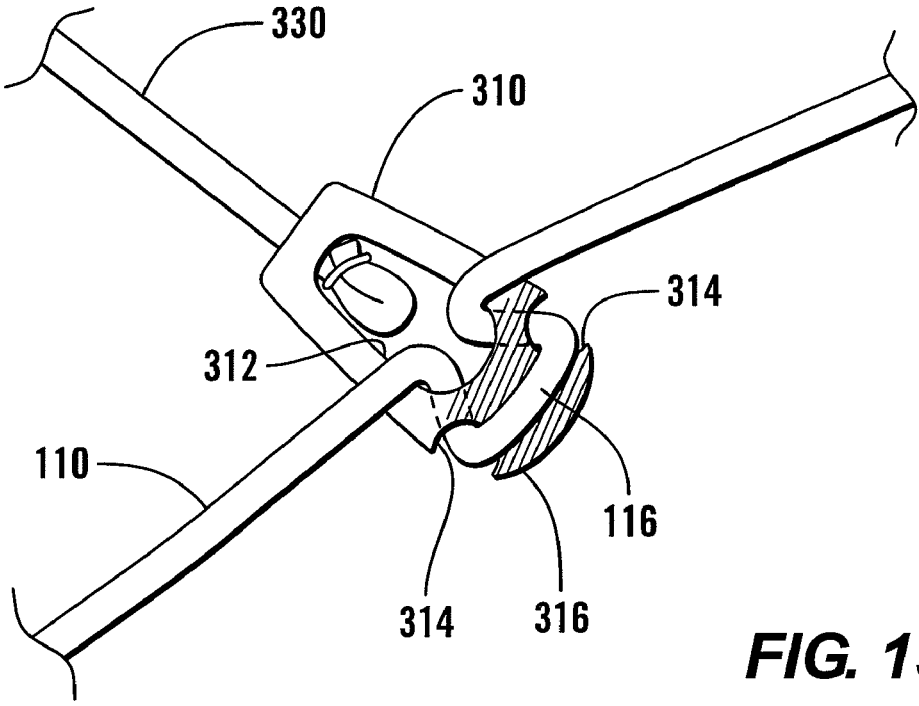
FIG. 15 is a rear isometric view of a bracket according to a first exemplary embodiment coupled to an anchor line according to the first exemplary method.

FIGS. 14 and 15 illustrate a first exemplary method of coupling bracket 310 to anchor line 110 using the first exemplary embodiment of bracket 310. As shown in FIGS. 14 and 15, loop 116 of anchor line 110 is passed through line passage hole 312 and channels 314 and around hook 316.

It should be appreciated that, although the anchor line stabilizer has been described as particularly useful for maintaining a boat's position relative to an anchor, the anchor line stabilizer may have other uses including, for example, tensioning a line for a boat mooring, tensioning a line for a wind tarp or tensioning a trailer tie line. In general, the above-outlined anchor line stabilizer may be useful for tensioning any rope, line or the like that is subjected to variable degrees of force or strain.

While this invention has been described in conjunction with the exemplary embodiments outlined above, various alternatives, modifications, variations, improvements and/or substantial equivalents, whether known or that are or may be presently foreseen, may become apparent to those having at least ordinary skill in the art. Accordingly, the exemplary embodiments of the invention, as set forth above, are intended to be illustrative, not limiting. Various changes may be made without departing from the spirit or scope of the invention. Therefore, the invention is intended to embrace all known or earlier developed alternatives, modifications, variations, improvements and/or substantial equivalents.

The invention claimed is:

1. An anchor line stabilizer comprising:

a flexible member having a first and a second end;

a first bracket coupled to the first end of the flexible member;

the first bracket comprising a generally planar member having a first face opposite a second face, a first end and a second end, the generally planar member defining the perimeter of a line passage hole and the perimeter of a first receiving hole, the line passage hole interiorly located through the first bracket and interconnecting the first face and the second face of the generally planar member, the first receiving hole extending between the first and second faces of the generally planar member and interconnecting the second end of the generally planar member and the perimeter of the line passage hole, a first channel and a second channel forming a portion of a two sided hook on the first end of the first bracket, wherein the first and second channels extend through the first bracket interconnecting the first face and the second face of the generally planar member, and the first bracket has a tapered profile such that a thickness of the member between the first and second faces at the first end is narrower than a thickness of the member between the first and second faces at the second end.

2. The anchor line stabilizer of claim 1, wherein the first end of the flexible member is coupled directly to the first receiving hole of the first bracket.

3. The anchor line stabilizer of claim 1, wherein the first end of the flexible member is received by the first receiving hole of the first bracket.

4. The anchor line stabilizer of claim 1, further comprising:

a second bracket coupled to the second end of the flexible member;

the second bracket comprising a generally planar member having a first face opposite a second face, a first end and a second end, the generally planar member defining the perimeter of a line passage hole and the perimeter of a first receiving hole, the line passage hole interiorly located through the second bracket and interconnecting the first face and the second face of the generally planar member, the first receiving hole extending between the first and second faces of the generally planar member and interconnecting the second end of the generally planar member and the perimeter of the line passage hole, a first channel and a second channel forming a portion of a two sided hook on the first end of the second bracket, wherein the first and second channels extend through the second bracket interconnecting the first face and the second face of the generally planar member, and the second bracket has a tapered profile such that a thickness of the member between the first and second faces at the first end is narrower than a thickness of the member between the first and second faces at the second end.

5. The anchor line stabilizer of claim 4, wherein the first end of the flexible member is coupled directly to the first receiving hole of the first bracket and the second end of the flexible member is coupled directly to the first receiving hole of the second bracket.

6. The anchor line stabilizer of claim 4, wherein the first end of the flexible member is received by the first receiving hole of the first bracket and the second end of the flexible member is received by the first receiving hole of the second bracket.

7. The anchor line stabilizer of claim 4, further comprising an anchor line coupled to the first bracket and the second bracket.

8. The anchor line stabilizer of claim 4, wherein a first portion of the flexible member is received within the line passage hole of the first bracket and a second portion of the flexible member is received within the line passage hole of the second bracket.

9. The anchor line stabilizer of claim 4, wherein the line passage hole of the first bracket is perpendicular to the first receiving hole of the first bracket, and the line passage hole of the second bracket is perpendicular to the first receiving hole of the second bracket.

10. The anchor line stabilizer of claim 1, further comprising an anchor line coupled to the first bracket.

11. The anchor line stabilizer of claim 1, wherein a portion of the flexible member is received by the first receiving hole and extends into within the line passage hole of the first bracket.

12. An anchor line stabilizer comprising:

a first bracket including a substantially planar member having a first face opposite a second face, a first end and a second end, wherein the first bracket has a tapered profile such that a thickness of the substantially planar member between the first face and second face is greater at the second end than the first end;

a first channel and a second channel provided on the first end of the first bracket, each channel extending through the substantially planar member from the first face to the second face to form a two-sided hook;

a line passage hole provided through the substantially planar member from the first face to the second face, wherein the perimeter of the line passage hole is defined by the substantially planar member;

a receiving hole provided perpendicular to the line passage hole and interconnecting the line passage hole and second end of the first bracket, wherein the perimeter of the receiving hole is defined by the substantially planar member; and a flexible member having a first end and a second end, wherein the first end is received by the receiving hole of the first bracket.

13. The anchor line stabilizer of claim 12, further comprising:

a second bracket including a substantially planar member having a first face opposite a second face, a first end and a second end, wherein the second bracket has a tapered profile such that a thickness of the substantially planar member between the first face and second face is greater at the second end than the first end;

a first channel and a second channel provided on the first end of the second bracket to form a two-sided hook;

a line passage hole provided through the substantially planar member from the first face to the second face, wherein the perimeter of the line passage hole is defined by the substantially planar member; and a receiving hole provided perpendicular to the line passage hole and interconnecting the line passage hole and second end of the second bracket, wherein the perimeter of the receiving hole is defined by the substantially planar member, and wherein the second end of the flexible member is received by the receiving hole of the second bracket.

14. An anchor line stabilizer comprising:

a first bracket comprising:

a substantially planar member having a first face opposite a second face, and a hook end opposite a receiving hole end;

a line passage hole provided through the substantially planar member and connecting the first face and the second face, wherein the perimeter of line passage hole is defined by the substantially planar member;

a first channel provided on the hook end and connecting the first face and the second face;

a second channel provided on the hook end and connecting the first face and the second face, wherein the first and second channels form a portion of a hook; and a receiving hole provided through a portion of the substantially planar member and extending from the receiving hole end to intersect the line passage hole, wherein the perimeter of the receiving hole is defined by the substantially planar member;

a second bracket comprising:

a substantially planar member having a first face opposite a second face, and a hook end opposite a receiving hole end;

a line passage hole provided through the substantially planar member and connecting the first face and the second face, wherein the perimeter of the line passage hole is defined by the substantially planar member;

a first channel provided on the hook end and connecting the first face and the second face;

a second channel provided on the hook end and connecting the first face and the second face, wherein the first and second channels form a portion of a hook; and a receiving hole provided through a portion of the substantially planar member and extending from the receiving hole end to intersect the line passage hole, wherein the perimeter of the receiving hole is defined by the substantially planar member; and a flexible member having a first end and a second end, wherein the first end is received by the receiving hole of the first bracket and the second end is received by the receiving hole of the second bracket.

15. The anchor line stabilizer of claim 14, wherein the hook of the first bracket and the hook of the second bracket are each T-hooks.

16. The anchor line stabilizer of claim 14, wherein the receiving hole of the first bracket is provided in between the first and second faces of the first bracket, and the receiving hole of the second bracket is provided in between the first and second faces of the second bracket.

17. The anchor line stabilizer of claim 14, wherein a portion of the first end of the flexible member is received within the line passage hole of the first bracket, and a portion of the second end of the flexible member is received within the line passage hole of the second bracket.

18. The anchor line stabilizer of claim 14, wherein the first bracket has a tapered profile such that a thickness of the substantially planar member between the first face and second face is greater at the receiving hole end than the hook end, and the second bracket has a tapered profile such that a thickness of the substantially planar member between the first face and second face is greater at the receiving hole end than the hook end.

19. The anchor line stabilizer of claim 14, wherein the receiving hole of the first bracket is perpendicular to the line passage hole of the first bracket, and the receiving hole of the second bracket is perpendicular to the line passage hole of the second bracket.

* * * * *

UNITED STATES PATENT AND TRADEMARK OFFICE

CERTIFICATE OF CORRECTION

PATENT NO. : 7,987,802 B2
APPLICATION NO. : 12/428235
DATED : August 2, 2011
INVENTOR(S) : Niedermair It is certified that error appears in the above-identified patent and that said Letters Patent is hereby corrected as shown below:

In the Specification

In Column 5, Line 12, delete "surface 220" and insert -- surface 210 --, therefor.

In Column 5, Line 43, delete "surface 220" and insert -- surface 210 --, therefor.

In the Claims

In Column 9, Line 35, in Claim 11, delete "into within the" and insert -- into the --, therefor.

In Column 10, Line 21, in Claim 14, delete "of line" and insert -- of the line --, therefor.

Signed and Sealed this
Nineteenth Day of November, 2013

Teresa Stanek Rea

Teresa Stanek Rea
*Deputy Director of the United States Patent and Trademark Office*